US005713224A

United States Patent [19]

Liou

[11] Patent Number: 5,713,224

[45] Date of Patent: Feb. 3, 1998

[54] LOCK DEVICE WITH ACCIDENTAL LOCKING PREVENTION

[76] Inventor: Gaieter Liou, No. 151, Tong Hwa St., San Min Dist., Kaohsiung, Taiwan

[21] Appl. No.: 779,558

[22] Filed: Jan. 7, 1997

[51] Int. Cl.[6] ..... E05B 67/36

[52] U.S. Cl. ..... 70/34; 70/52; 70/128; 70/389; 70/DIG. 79

[58] Field of Search ..... 70/52, 389, 128, 70/31–35, 38 R, 99, 100, 390, 406, DIG. 20, DIG. 27, DIG. 79

[56] References Cited

U.S. PATENT DOCUMENTS

| | | | |
|---|---|---|---|
| 1,453,139 | 4/1923 | Huston | 70/34 |
| 1,846,822 | 2/1932 | Vogt | 70/100 |
| 1,873,462 | 8/1932 | North | 70/DIG. 20 X |
| 1,907,625 | 5/1933 | Vogt | 70/DIG. 79 |
| 2,098,249 | 11/1937 | Kistner | 70/128 |
| 2,395,762 | 2/1946 | Rober | 70/35 |
| 2,656,704 | 10/1953 | Mancuso | 70/33 X |
| 2,845,789 | 8/1958 | Kistner | 70/100 |
| 3,082,617 | 3/1963 | Kerman | 70/100 |
| 4,183,235 | 1/1980 | Coralli et al. | 70/34 |
| 4,565,078 | 1/1986 | Soloman | 70/DIG. 27 X |

*Primary Examiner*—Lloyd A. Gall

*Attorney, Agent, or Firm*—Bacon & Thomas

[57] ABSTRACT

A lock device includes a body having a lock core mounted therein and a first hole. A casing is securely mounted around the body. The casing includes a second hole in alignment with the first hole of the body. A first side of the casing includes a rectangular slot defined therein and a side slot in communication with the rectangular slot. A hollow guiding member is securely attached to a second side of the casing and has a through hole in alignment with the first and second holes. The guiding member includes a non-linear guiding slot defined in a periphery thereof, the non-linear guiding slot including a section which extends in a direction having an angle with a longitudinal axis of the first and second holes. A latch rod extends through the first and second holes. The latch rod includes a first enlarged end located on the first side of the casing and a second end having a pin hole therein, a spring mounted therearound and adjacent to the first enlarged end thereof, an annular recess defined in a mediate portion thereof, and a guiding pin slidably mounted in the guiding slot, the guiding pin being partially received in the pin hole and extending beyond the guiding slot.

2 Claims, 3 Drawing Sheets

LOCK DEVICE WITH ACCIDENTAL LOCKING PREVENTION

BACKGROUND OF THE INVENTION

The present invention relates to a lock device which may prevent accidental locking.

A conventional latch rod type lock device is generally locked by linearly moving the latch rod such that accidental locking often occurs. The present invention is intended to provide an improved lock device which may prevent accidental locking.

SUMMARY OF THE INVENTION

A lock device in accordance with the present invention generally comprises a body including a lock core mounted therein and a first hole. A latch pin is mounted in the body and operable by the lock core to be movable between a locking position and an unlocking position.

A casing is securely mounted around the body to cover the lock core except the keyway and the first hole. The casing including a second hole in alignment with the first hole of the body. A first side of the casing includes a rectangular slot defined therein and a side slot in communication with the rectangular slot.

A hollow guiding member is securely attached to the second side of the casing and having a through hole in alignment with the first hole and the second hole. The guiding member includes a non-linear guiding slot defined in a periphery thereof. The non-linear guiding slot includes a section which extends in a direction having an angle with a longitudinal axis of the first and second holes.

A latch the rod extends through the first hole and second hole. The latch rod includes a first enlarged end located on the first side of the casing and a second end having a pin hole therein, a spring mounted therearound and adjacent to the first enlarged end thereof, an annular recess defined in a mediate portion thereof, and a guiding pin slidably mounted in the guiding slot. The guiding pin is partially received in the pin hole and extends beyond the guiding slot.

A flat key is extendible through the rectangular slot of the casing into the keyway. The key includes a reduced neck formed in an upper end thereof. The neck has a length greater than a thickness of the casing, wherein the neck is moved into the side slot when the key is rotated.

Preferably, the non-linear slot includes at least two linear slot sections, and each two adjacent linear slot sections have a transition section therebetween.

Other objects, advantages, and novel features of the invention will become more apparent from the following detailed description when taken in conjunction with the accompanying drawings.

Figure 1:
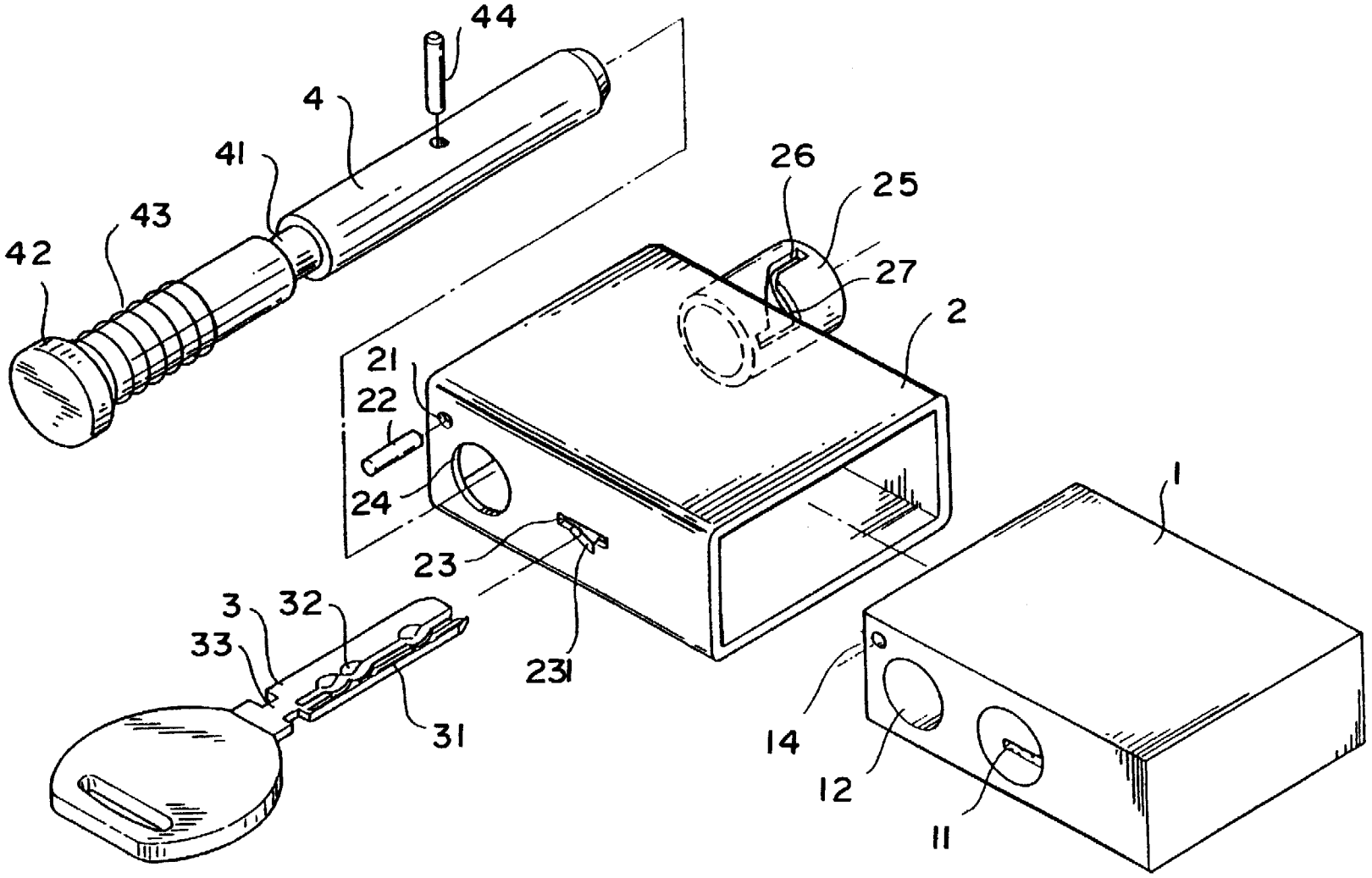
FIG. 1 is an exploded perspective view of a lock device in accordance with the present invention.
Figure 2:
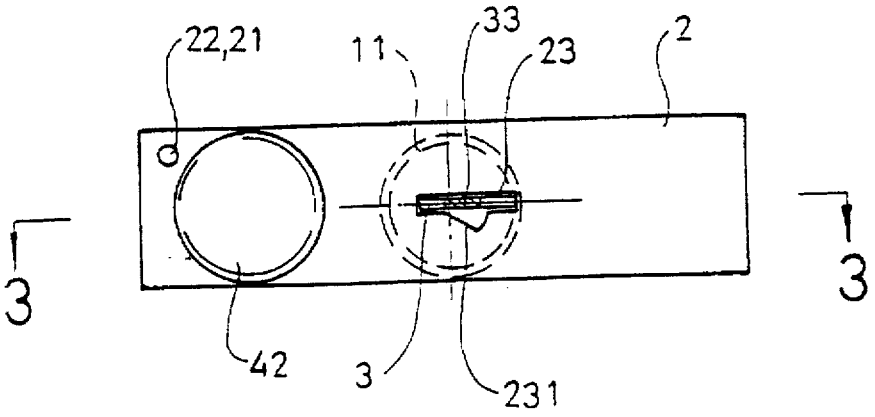
FIG. 2 is a front elevational view of the lock device.
Figure 3:
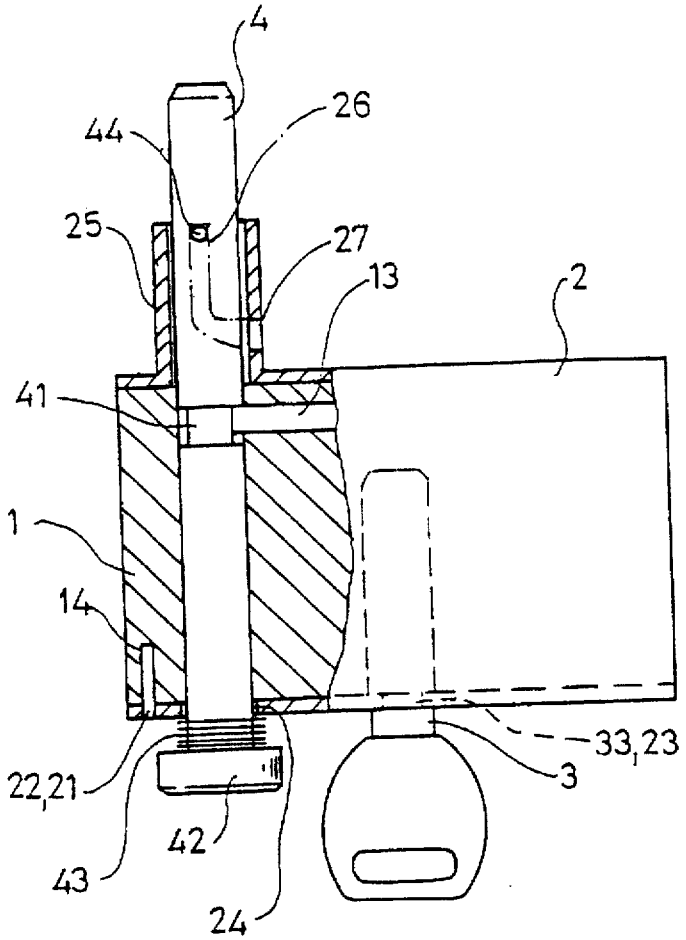
FIG. 3 is a cross-sectional view taken along line 3—3 in FIG. 2, in which the lock device is in a locked status.

Referring to the drawings and initially to FIGS. 1 to 3, a lock device in accordance with the present invention generally includes a body 1 and a casing 2. A lock core 11 is mounted in the body 1 and operable by a key 3 for unlocking of a latch rod 4. The body 1 includes a first hole 12 which will be further described later. The body 1 further includes at least one positioning hole 14 defined therein through which a pin 22 extend to engage with the casing 2.

The casing 2 is securely mounted around the body 1 by means of engaging the pin 22 extending through a hole 21 defined therein and through the positioning hole 14. Nevertheless, it is appreciated that the casing 2 may be fixedly secured around the body 1 by any suitable means. The casing 2 includes a second hole 24 in alignment with the first hole 12. The casing 2 further includes a rectangular slot 23 defined in a first side thereof and in alignment with the keyway and a side slot 231 in communication with the rectangular slot 23. The casing 2 covers the lock core 11 except the keyway and the first hole 12. Preferably, the casing 2 is made of hardened metal to prevent from being destructed by drilling or other means. A hollow guiding member 25 is securely attached to a second side of the casing 2 which is opposite to the first side of the casing 2. The hollow guiding member 25 has a through hole (not labeled) in alignment with the first hole and the second hole. A non-linear guiding slot 26 is defined in a periphery of the guiding member 25 and includes a transition section 27. The non-linear slot 26 may include at least two linear slot sections, and each two adjacent linear slot sections have a transition section 27 therebetween which extends in a direction having an angle with a longitudinal axis of the first and second holes 12 and 24.

The latch rod 4 includes a first enlarged end 42 located on the first side of the casing 2 and a second end having a pin hole therein. The latch rod 4 further includes a spring 43 mounted therearound and adjacent to the first enlarged end 42. An annular recess 41 is defined in a mediate portion of the latch rod 4, which will be described later. A guiding pin 44 is slidably mounted in the guiding slot 26. The guiding pin 44 is partially received in the pin hole and extends beyond the guiding slot 26.

The key 3 is preferably flat and includes teeth 31 and/or recesses 32 defined in two sides thereof for actuating the lock core 11 to rotate. In addition, the key 3 includes a reduced neck 33 formed in an upper end thereof. The neck 33 has a length greater than a thickness of the casing 2. In addition, when the key 3 is rotated, the neck 33 may be moved into the side slot 231.

Figure 4:
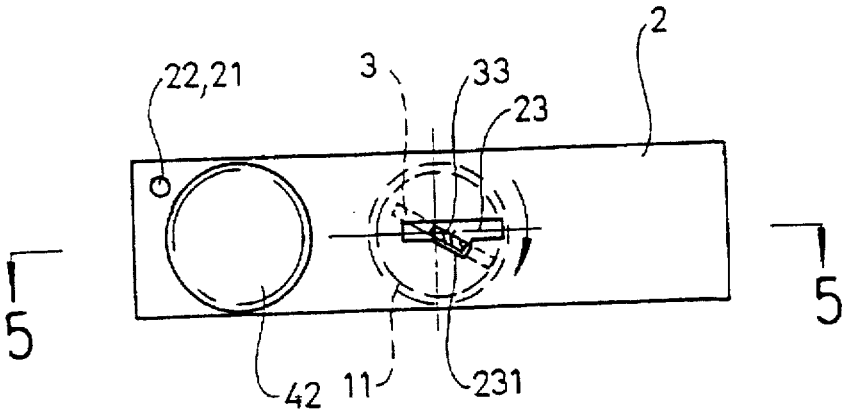
FIG. 4 is a front elevational view of the lock device illustrating unlocking thereof.
Figure 5:
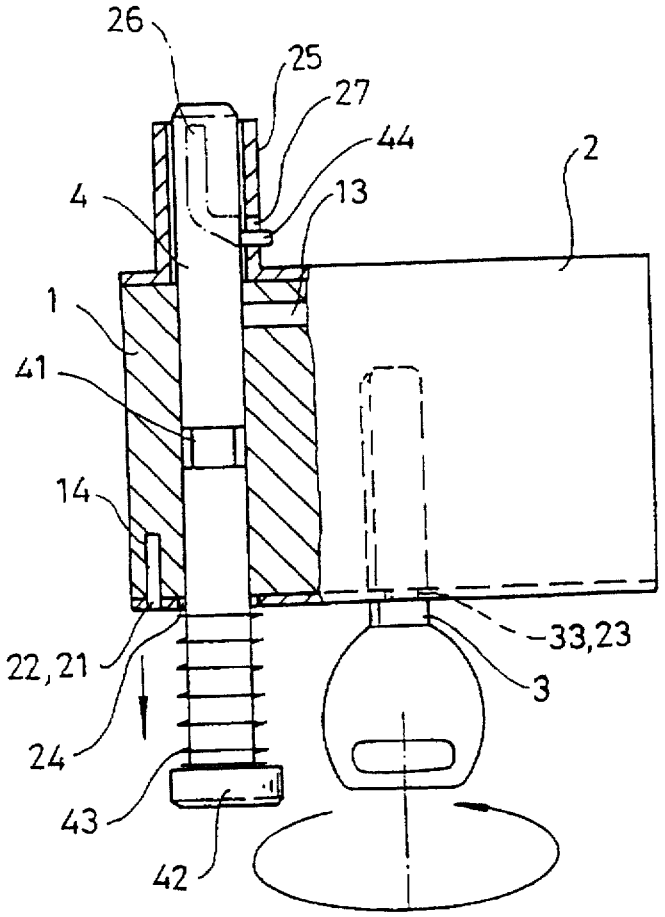
FIG. 5 is a cross-sectional view taken along line 5—5 in FIG. 4.

When in a locked status, as shown in FIG. 3, a latch pin 13 in the body 1 is extended into the annular recess 41 of the latch rod 4 to provide the locking function. The latch pin 13 may be extended to be received in the annular recess 41 or retracted to disengage from the annular recess 41 under operation of the lock core 11, which is conventional and therefore not further described. When the key 3 is inserted into the keyway (not labeled), the neck 33 is received in the triangular slot 23, as shown in FIGS. 2 and 3. When the key 3 is rotated, the neck 33 is moved into the side slot 231, as shown in FIG. 4, thereby achieving the unlocking function. For locking, the user has to push the latch rod 4 toward the casing 2 and then rotate the latch rod 4 so as to guide the guiding pin 44 through the transition section 27. Thereafter, the user has to push the latch rod 4 to a farther extent to accomplish the locking procedure. Accordingly, accidental locking will not happen since the guiding pin 44 cannot move through the transition section 27 of the guiding slot 26 without rotation. The spring 43 will return the latch rod 4 to its unlocked position as soon as the external force disappears.

Although the invention has been explained in relation to its preferred embodiment, it is to be understood that many other possible modifications and variations can be made without departing from the spirit and scope of the invention as hereinafter claimed.

What is claimed is:

1. A lock device, comprising:

a body including a lock core mounted therein, the lock core having a keyway, a latch pin being mounted in the body and operable by the lock core to be movable between a locking position and an unlocking position, the body further including a first hole;

a casing securely mounted around the body to cover the lock core except the keyway and the first hole, the casing including a second hole in alignment with the first hole of the body, the casing further including a first side and a second side, the first side of the casing including a rectangular slot defined therein and a side slot in communication with the rectangular slot;

a hollow guiding member securely attached to the second side of the casing and having a through hole in alignment with the first hole and the second hole, the guiding member including a non-linear guiding slot defined in a periphery thereof, the non-linear guiding slot including a section which extends in a direction having an angle with a longitudinal axis of the first and second holes;

a latch rod extending through the first hole and the second hole, the latch rod including:

a first enlarged end located on the first side of the casing and a second end having a pin hole therein, a spring mounted therearound and adjacent to the first enlarged end thereof, an annular recess defined in a mediate portion thereof, and a guiding pin slidably mounted in the guiding slot, the guiding pin being partially received in the pin hole and extending beyond the guiding slot; and a flat key extendible through the rectangular slot of the casing into the keyway, the key including a reduced neck formed in an upper end thereof, the neck having a length greater than a thickness of the casing, wherein the neck is moved into the side slot when the key is rotated.

2. The lock device according to claim 1, wherein the non-linear slot includes at least two linear slot sections, and each two adjacent said linear slot sections have a transition section therebetween.

* * * * *